US007826784B2

(12) United States Patent
Ito

(10) Patent No.: US 7,826,784 B2
(45) Date of Patent: Nov. 2, 2010

(54) TRANSFER UNIT, PHOTOCONDUCTOR CARTRIDGE AND IMAGE FORMING APPARATUS

(75) Inventor: Yoshinori Ito, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 397 days.

(21) Appl. No.: 12/014,164

(22) Filed: Jan. 15, 2008

(65) Prior Publication Data

US 2008/0181683 A1 Jul. 31, 2008

(30) Foreign Application Priority Data

Jan. 30, 2007 (JP) ..... 2007-019863

(51) Int. Cl.
*G03G 15/16* (2006.01)

(52) U.S. Cl. ..... 399/313

(58) Field of Classification Search ..... 399/313
See application file for complete search history.

(56) References Cited

U.S. PATENT DOCUMENTS

| | | | | |
|---|---|---|---|---|
| 4,379,630 | A * | 4/1983 | Suzuki | 399/313 |
| 6,173,139 | B1 | 1/2001 | Takahata et al. | |
| 6,223,015 | B1 | 4/2001 | Takahata et al. | |
| 6,408,158 | B1 | 6/2002 | Takahata et al. | |
| 2003/0035664 | A1 | 2/2003 | Takahata et al. | |
| 2003/0077091 | A1 | 4/2003 | Takahata et al. | |
| 2004/0028431 | A1 | 2/2004 | Takahata et al. | |

FOREIGN PATENT DOCUMENTS

| | | | |
|---|---|---|---|
| JP | 07-199689 | | 8/1995 |
| JP | 08-123151 | | 5/1996 |
| JP | 8-286393 | A | 11/1996 |
| JP | 10-240027 | A | 9/1998 |
| JP | 10-268671 | A | 10/1998 |
| JP | 2001-22251 | A | 1/2001 |
| JP | 2001-082452 | A | 3/2001 |
| JP | 2002-214938 | A | 7/2002 |
| JP | 2002-268409 | A | 9/2002 |
| JP | 2002-351233 | | 12/2002 |
| JP | 2004-301929 | | 10/2004 |
| JP | 2005-062746 | A | 3/2005 |
| JP | 2005-077541 | A | 3/2005 |

OTHER PUBLICATIONS

JP Office Action dtd Jul. 30, 2009, JP Appln. 2009-0026230, English Translation.
JP Office Action dtd Aug. 28, 2008, JP App 2007-019863.

* cited by examiner

*Primary Examiner*—Constantine Hannaher
(74) *Attorney, Agent, or Firm*—Banner & Witcoff, Ltd.

(57) ABSTRACT

A transfer unit includes a transfer roller. The transfer roller includes an electrically conductive rotation shaft, a conductive elastic layer for covering a periphery of the rotation shaft, and a semiconductive cover layer provided between the rotation shaft and the elastic layer at least in both end portions in an axial direction of the rotation shaft.

14 Claims, 7 Drawing Sheets

TRANSFER UNIT, PHOTOCONDUCTOR CARTRIDGE AND IMAGE FORMING APPARATUS

CROSS-REFERENCE TO RELATED APPLICATIONS

This application claims priority from Japanese Patent Application No. 2007-019863 filed on Jan. 30, 2007, the entire subject matter of which is incorporated herein by reference.

TECHNICAL FIELD

Aspects of the invention relate to an image forming apparatus such as a laser printer and a photoconductor cartridge and a transfer unit installed in the image forming apparatus.

BACKGROUND

An image forming apparatus includes a photoconductor drum for carrying a toner image and a transfer roller placed facing the photoconductor drum for transferring the toner image to a sheet. The transfer roller is pressed against the photoconductor drum and a transfer bias for transferring the toner image to a sheet is applied to the transfer roller. The toner image carried on the photoconductor drum is transferred to the sheet when the sheet passes through the nip between the photoconductor drum and the transfer roller.

SUMMARY

Aspects of the invention provide a transfer unit capable of preventing a transfer failure caused by the difference in resistance value along an axial direction of a rotation shaft according to a simple configuration in a transfer roller including an ionic conductive elastic layer. Further, aspects of the invention also provide a photoconductor cartridge and an image forming apparatus including the transfer unit.

BRIEF DESCRIPTION OF THE DRAWINGS

FIGS. 3A and 3B are exemplary sectional side views showing support of a transfer roller, in which FIG. 3A shows a detachment state of a process cartridge from a main body casing, and FIG. 3B shows a placement state of the process cartridge in the main body casing;

FIGS. 6A and 6B are exemplary correlation diagrams of plotting resistance values of the transfer roller relative to the axial position percentage, in which FIG. 6A is a correlation diagram, and FIG. 6B is a schematic diagram for finding a formation area of a cover layer from the correlation diagram;

DETAILED DESCRIPTION

General Overview

Figure 1:
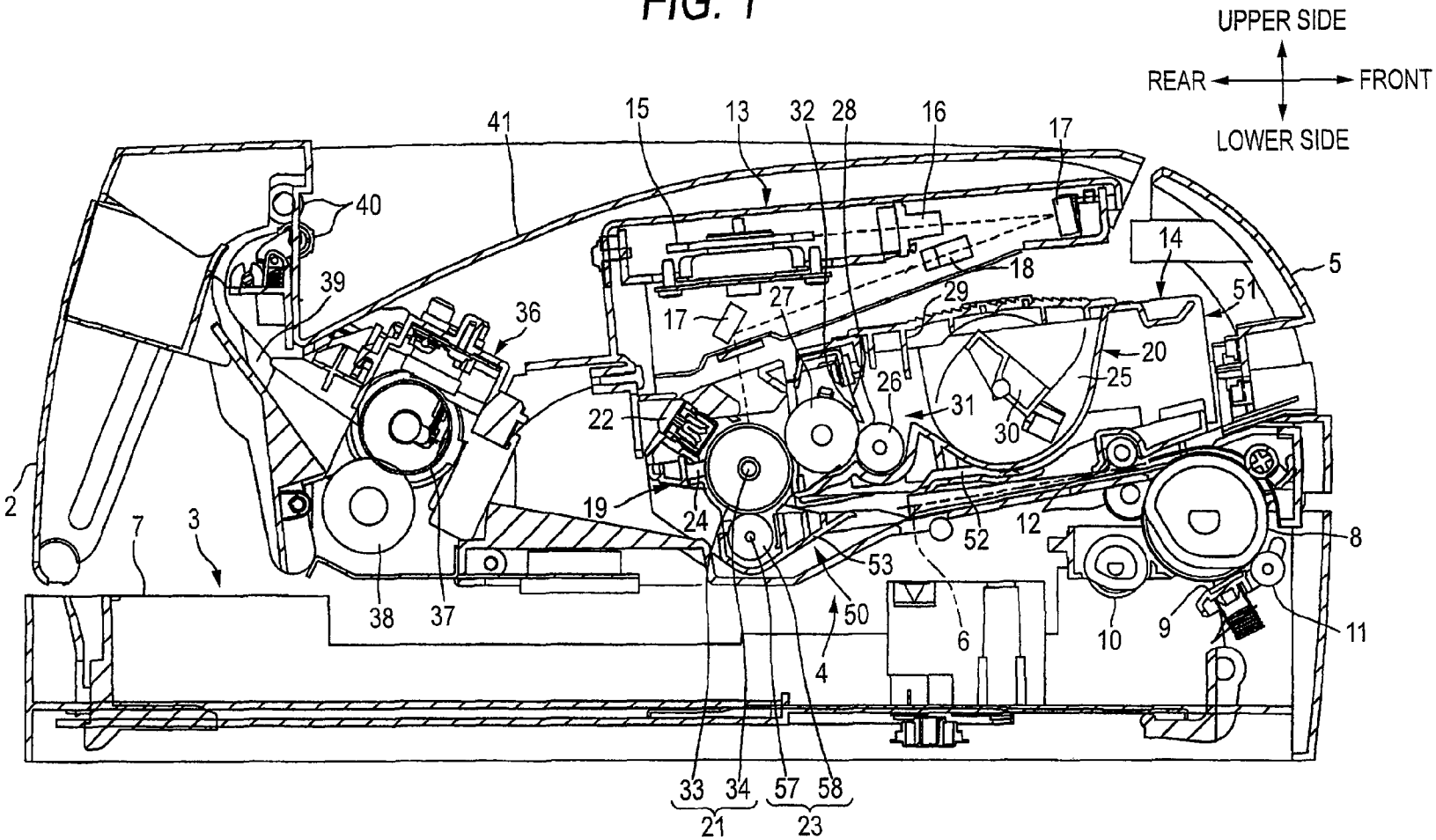
FIG. 1 is an exemplary sectional side view of a main part of an image forming apparatus.

According to an aspect of the invention, there is provided a transfer unit including: a transfer roller including: an electrically conductive rotation shaft; a conductive elastic layer for covering a periphery of the rotation shaft; and a semiconductive cover layer provided between the rotation shaft and the elastic layer at least in both end portions in an axial direction of the rotation shaft.

According to another aspect of the invention, there is provided a photoconductor cartridge including: a transfer unit including: a transfer roller including: an electrically conductive rotation shaft; a conductive elastic layer for covering a periphery of the rotation shaft; and a semiconductive cover layer provided between the rotation shaft and the elastic layer at least in both end portions in an axial direction of the rotation shaft; and a photoconductor that faces the transfer roller in order to press contact with the transfer roller, the photoconductor carrying a developer image.

According to still another aspect of the invention, there is provided an image forming apparatus including: a transfer unit including: a transfer roller including: an electrically conductive rotation shaft; a conductive elastic layer for covering a periphery of the rotation shaft; and a semiconductive cover layer provided between the rotation shaft and the elastic layer at least in both end portions in an axial direction of the rotation shaft; a photoconductor that faces the transfer roller in order to press contact with the transfer roller, the photoconductor carrying a developer image; and a press member that presses both end portions in the axial direction of the transfer roller against the photoconductor.

<Illustrative Aspects>

Illustrative aspects of the invention will be described with reference to the drawings.

The transfer roller includes a metal rotation shaft and an elastic layer for covering the periphery of the rotation shaft. The elastic layer is formed of an electrically conductive foamed material.

Both end portions of the rotation shaft in an axial direction thereof are pressed against the photoconductor drum by a press member, whereby the transfer roller is brought into press contact with the photoconductor drum. Thus, the press pressure of the transfer roller against the photoconductor drum is higher at both end portions of the rotation shaft in the axial direction thereof than that at the center portion of the rotation shaft in the axial direction thereof.

In the elastic layer, the more pressure the elastic layer receives, the more a resistance value of the elastic layer increases. That is, when the transfer roller is brought into press contact with the photoconductor drum, the resistance value at both end portions of the transfer roller becomes higher than the resistance value at the center portion of the transfer roller. Since the transfer bias is not uniformly applied in the axial direction of the rotation shaft, a transfer failure may occur.

However, with a transfer roller including an elastic layer of ion conductivity, if an elastic layer having a high resistance value is provided at the center portion of a rotation shaft in the axial direction thereof and an elastic layer having a low resistance value is provided at the end portion of the rotation shaft in the axial direction thereof, a transfer failure may not be prevented.

Aspects of the invention provide a transfer unit capable of preventing a transfer failure caused by the difference in resistance value along an axial direction of a rotation shaft according to a simple configuration in a transfer roller including an ionic conductive elastic layer. Further, aspects of the invention also provide a photoconductor cartridge and an image forming apparatus including the transfer unit.

1. Laser Printer

FIG. 1 is an exemplary sectional side view of a main part of a laser printer that is an example of an image forming apparatus. In FIG. 1, a laser printer 1 includes a main body casing 2 and a feeder unit 3 and an image forming unit 4 provided in the main body casing 2.

The main body casing 2 is provided on one side wall with a front cover 5. The lower end portion of the front cover 5 is supported on the side wall for rotation through a hinge. If the front cover 5 is opened with the lower end portion of the front cover 5 as a supporting point, the internal space of the main body casing 2 is opened. Accordingly, a process cartridge 14 (described later) can be attached to and detached from the internal space of the main body casing 2. If the front cover 5 is closed with the lower end portion of the front cover 5 as the supporting point, the internal space of the main body casing 2 is closed. The front cover 5 includes an operation panel. The operation panel includes operation keys and an LED display section (not shown).

Hereinafter, as for the laser printer 1 and the process cartridge 14, the side where the front cover 5 is provided is called "front," and the opposite side thereof is called "rear."

1) Feeder Unit

The feeder unit 3 feeds a sheet 6 as a transfer medium to the image forming unit 4. The feeder unit 3 is placed in the bottom of the main body casing 2. The feeder unit 3 includes a sheet feed tray 7, a sheet feed roller 8, a sheet feed pad 9, a pickup roller 10, a pinch roller 11, and a registration roller 12.

The sheet feed tray 7 is detachably placed in the bottom of the main body casing 2. The sheets 6 are stacked in the sheet feed tray 7.

The sheet feed roller 8 and the sheet feed pad 9 are placed facing each other and are provided above the front end portion of the sheet feed tray 7. The pickup roller 10 is provided above the front end portion of the sheet feed tray 7 and at the rear of the sheet feed roller 8. The pinch roller 11 is provided below the front of the sheet feed roller 8. The registration roller 12 is provided above the rear of the sheet feed roller 8.

The top sheet 6 in the sheet feed tray 7 is pressed against the pickup roller 10 and is transported to the nip between the sheet feed roller 8 and the sheet feed pad 9 by rotation of the pickup roller 10. When the sheet 6 is sandwiched between the sheet feed roller 8 and the sheet feed pad 9, the sheet 6 is fed one sheet at a time by rotation of the sheet feed roller 8. Then, the sheet 6 passes through the nip between the sheet feed roller 8 and the pinch roller 11 and is transported to the registration roller 12.

The registration roller 12 includes a pair of rollers opposed to each other and transports the sheet 6 to a transfer position after registration. The transfer position is a nip position between a photoconductive drum 21 (described later) and a transfer roller 23 (described later).

2) Image Forming Unit

The image forming unit 4 includes a scanner 13, a process cartridge 14, and a fixing unit 36.

2-1) Scanner

The scanner 13 is provided in an upper part of the main body casing 2. It includes a laser light source (not shown), a polygon mirror 15, an fθ lens 16, two reflecting mirrors 17, and a lens 18.

A laser beam based on image data is emitted from the laser light source. As indicated by the chain line in FIG. 1, the beam is deflected on the polygon mirror 15, passes through the fθ lens 16, bent by one reflecting mirror 17, passes through the lens 18, bent by the other reflecting mirror 17 and applied to the surface of the photoconductive drum 21 (described later).

2-2) Process Cartridge

The process cartridge 14 is provided below the scanner 13 and is detachably placed in the main body casing 2.

The process cartridge 14 includes a drum cartridge 19 as an example of a photoconductor drum, a developing cartridge 20 detachably placed in the drum cartridge 19, the above-mentioned photoconductive drum 21, as an example of a photoconductor, provided in the drum cartridge 19, a scorotron type charger 22, the above-mentioned transfer roller 23, and a conductive brush 24.

a) Developing Cartridge

The developing cartridge 20 includes a toner storage chamber 25, a supply roller 26, a developing roller 27, and a layer thickness regulation blade 28.

The toner storage chamber 25 is formed as an internal space in the front side of the developing cartridge 20 partitioned by a partition plate 29. The toner storage chamber 25 stores nonmagnetic single component toner of positive electrostatic property as a developer. An agitator 30 is provided in the toner storage chamber 25. The toner in the toner storage chamber 25 is agitated with the agitator 30 and is released from an opening 31 below the partition plate 29.

The supply roller 26 is supported on the developing cartridge 20 for rotation at the rear of the opening 31. It includes a metal roller shaft and an electrically conductive sponge roller covering the periphery of the roller shaft.

The developing roller 27 is supported on the developing cartridge 20 for rotation at the rear of the supply roller 26. The developing roller 27 includes a metal roller shaft and an electrically conductive rubber roller covering the periphery of the roller shaft. The developing roller 27 is brought into contact with the supply roller 26 so that they are mutually compressed. A developing bias is applied to the developing roller 27 during the developing operation.

The layer thickness regulation blade 28 includes a blade made of a plate spring member and a press part 32 made of insulative silicone rubber. One end portion of the blade is supported on the developing cartridge 20 above the developing roller 27. An opposite end portion of the blade is provided with the press part 32. The press part 32 is brought into press contact with the surface of the developing roller 27 by an elastic force of the blade.

The toner released from the opening 31 is supplied to the developing roller 27 by rotation of the supply roller 26. At this time, the toner is frictionally charged positively between the supply roller 26 and the developing roller 27. Then, the toner enters the nip between the press part 32 of the layer thickness regulation blade 28 and the developing roller 27 by rotation of the developing roller 27 and is carried on the surface of the developing roller 27 as a thin layer of a given thickness.

b) Photoconductive Drum

The photoconductive drum 21 includes a cylindrical drum base tube 33 and a metal drum shaft 34. The surface layer of the drum base tube 33 is formed of a photosensitive layer of positive electrostatic property. The drum shaft 34 is placed along an axis center of the drum base tube 33. The drum shaft 34 is supported unrotatably on the drum cartridge 19. The drum base tube 33 is supported on the drum shaft 34 for rotation. Accordingly, the drum base tube 33 is supported rotatably with the drum shaft 34 as the center portion in the drum cartridge 19.

c) Scorotron Type Charger

The scorotron type charger 22 is supported on the drum cartridge 19 in a slanting direction above the rear of the photoconductive drum 21. The scorotron type charger 22 is placed facing the photoconductive drum 21 with a spacing so as not to come in contact with the photoconductive drum 21. The scorotron type charger 22 is a scorotron type charger of positive electrostatic property for causing corona discharge to occur.

d) Transfer Roller

The transfer roller 23 is supported on the drum cartridge 19 for rotation below the photoconductive drum 21. The transfer roller 23 includes a roller shaft 57 as an example of rotation shaft and a rubber roller 58 as an example of elastic layer. The rubber roller 58 covers the periphery of the roller shaft 57. When the process cartridge 14 is placed in the main body casing 2, the rubber roller 58 is brought into press contact with the photoconductive drum 21 from below. Accordingly, a nip is formed between the photoconductive drum 21 and the transfer roller 23. A transfer bias is applied to the transfer roller 23 during the transferring operation.

e) Conductive Brush

The conductive brush 24 is placed facing the photoconductive drum 21 at the rear of the photoconductive drum 21. The conductive brush 24 is fixed to the drum cartridge 19 so that the tip of the brush comes in contact with the surface of the photoconductive drum 21.

f) Transfer Operation

The surface of the photoconductive drum 21 is uniformly charged positively by the scorotron type charger 22. Then, the surface of the photoconductive drum 21 is exposed to light with a laser beam scanned from the scanner 13, whereby an electrostatic latent image is formed based on image data.

When the toner carried on the surface of the developing roller 27 is opposed to the photoconductive drum 21 by rotation of the developing roller 27, the toner is supplied to the electrostatic latent image formed on the surface of the photoconductive drum 21. That is, the toner is supplied to the exposure portion where the potential lowers by light exposure of the laser beam of the surface of the photoconductive drum 21 uniformly charged positively. Consequently, the toner is selectively carried in the exposure portion, whereby the electrostatic latent image is visualized and accordingly the toner image as a developer image is carried on the surface of the photoconductive drum 21.

The photoconductive drum 21 and the transfer roller 23 are rotated so as to transport a sheet 6 sandwiched therebetween. While the sheet 6 passes through the nip between the photoconductive drum 21 and the transfer roller 23, the toner image carried on the surface of the photoconductive drum 21 is transferred to the surface of the sheet 6.

After the transfer, paper dust deposited on the surface of the photoconductive drum 21 due to contact with the sheet 6 is removed with the conductive brush 24 when the surface of the photoconductive drum 21 faces the conductive brush 24 with rotation of the photoconductive drum 21.

2-3) Fixing Unit

The fixing unit 36 is provided at the rear of the process cartridge 14 as shown in FIG. 1. The fixing unit 36 includes a heating roller 37 and a pressure roller 38. The heating roller 37 includes a metal base tube and a halogen lamp placed along the axis center of the metal base tube. The pressure roller 38 is placed below the heating roller 37. It presses the heating roller 37 from below.

The fixing unit 36 thermally fixes the toner transferred to the surface of the sheet 6 while the sheet 6 passes through the nip between the heating roller 37 and the pressure roller 38.

The sheet 6 with the toner fixed thereon is transported to a sheet ejection path 39 extending in the up and down direction toward the upper face of the main body casing 2. Then, the sheet 6 is ejected onto a sheet ejection tray 41 formed on the upper face of the main body casing 2 by a sheet ejection roller 40 provided above the sheet ejection path 39.

2. Transfer Unit

Figure 2:
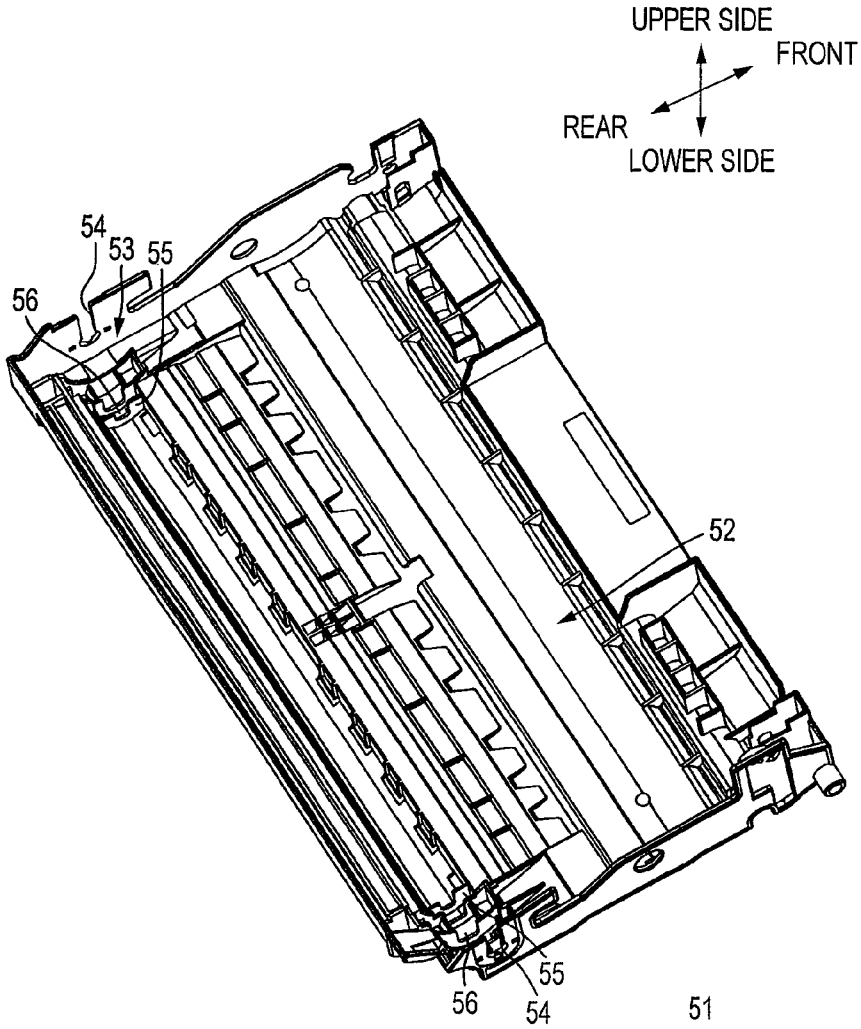
FIG. 2 is an exemplary perspective view of a drum frame.
Figure 3A:
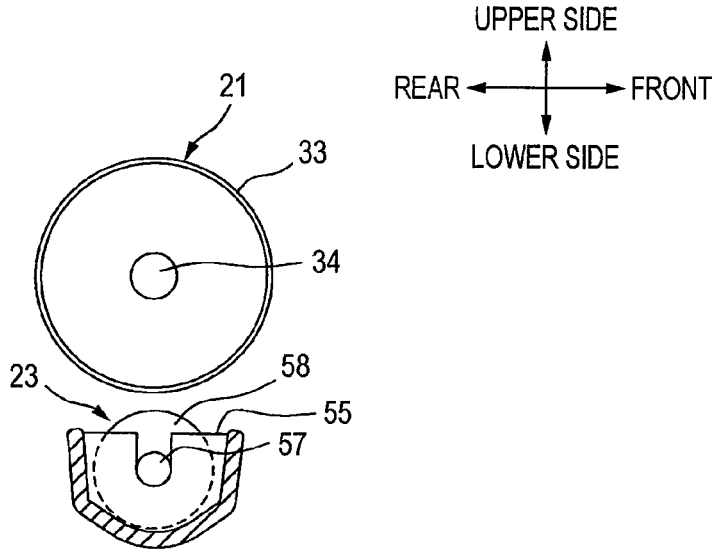
Figure 3B:
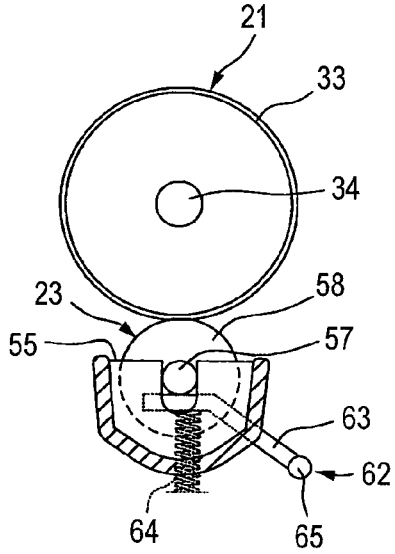
Figure 4:
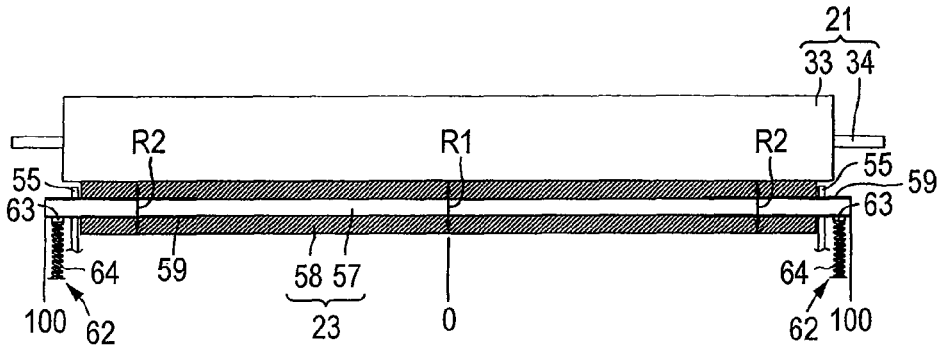
FIG. 4 is an exemplary sectional view in an axial direction of the transfer roller.
Figure 5:
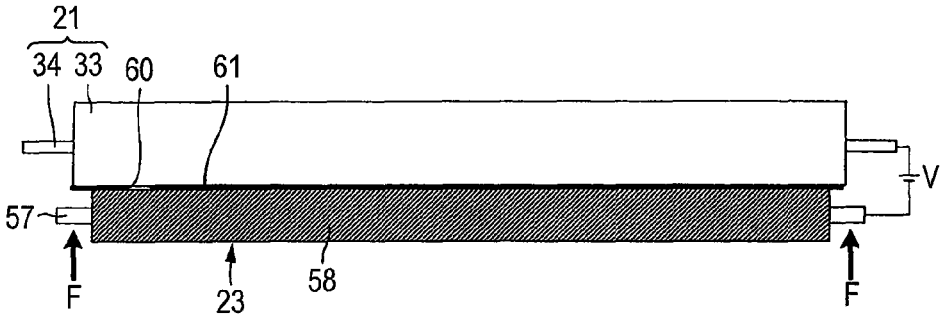
FIG. 5 is an exemplary schematic diagram showing a measurement method of a resistance value in the axial direction of the transfer roller.
Figure 6A:
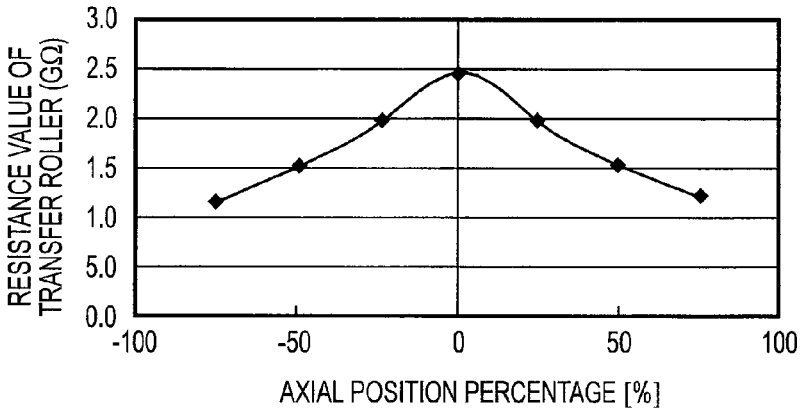
Figure 6B:
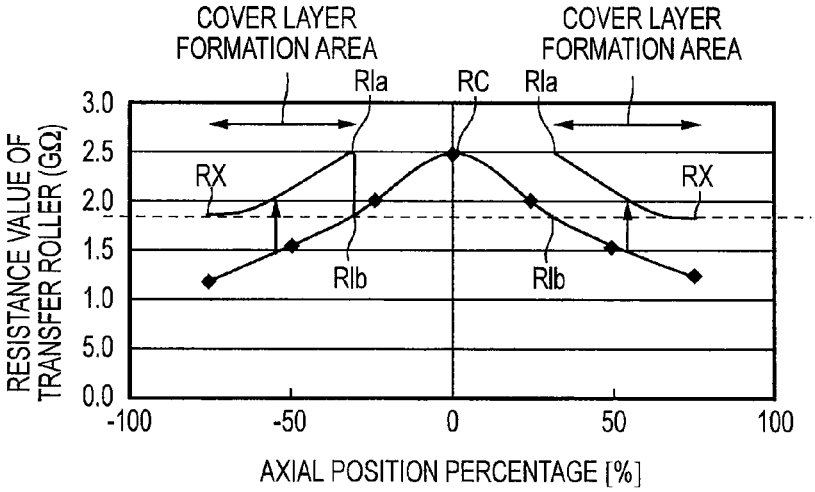

FIG. 2 is an exemplary perspective view of a drum frame 51 from above. FIGS. 3A and 3B are exemplary sectional side views showing support of the transfer roller shown in FIG. 1, in which FIG. 3A shows a detachment state of the process cartridge from the main body casing, and FIG. 3B shows a placement state of the process cartridge in the main body casing. FIG. 4 is an exemplary sectional view in an axial direction of the transfer roller shown in FIG. 1. FIG. 5 is an exemplary schematic diagram showing a measurement method of a resistance value in the axial direction of the transfer roller. FIGS. 6A and 6B are exemplary correlation diagrams of plotting resistance values of the transfer roller relative to the axial position percentage, in which FIG. 6A is a correlation diagram, and FIG. 6B is a schematic representation to find a formation area of a cover layer from the correlation diagram.

A transfer unit 50 as an example of transfer unit is provided in the drum cartridge 19. The transfer unit 50 includes a drum frame 51 and the transfer roller 23 supported on the drum frame 51. A press unit 62 as an example of press member is provided in the main body casing 2.

1) Drum Frame

As shown in FIG. 2, the drum frame 51 includes a developing cartridge reception section 52 on the front and a roller support section 53 on the rear.

The developing cartridge 20 is detachably placed in the developing cartridge reception section 52.

The roller support section 53 supports the photoconductive drum 21 and the transfer roller 23 for rotation. That is, a support groove 54 extending in the up and down direction is formed in the upper sides of both side walls of the roller support section 53. Both end portions of the drum shaft 34 of the photoconductive drum 21 are inserted into the support grooves 54 such that the deepest part of the drum shaft 34 is fixed unrotatably while the cylindrical drum base tube 33 is supported rotatably. Accordingly, the photoconductive drum 21 is supported in the roller support section 53 for rotation.

The roller support section 53 is provided on the bottom wall with support plates 55 each notched roughly like a letter U inside in the width direction of the support grooves 54. The roller support section 53 is provided on the bottom wall with insertion holes 56 each between each support groove 54 and each support plate 55.

Each support plate 55 is placed outside both outer end margins in the axial direction of the rubber roller 58 (see FIG. 4). Each insertion hole 56 is placed so as to face both end portions of the roller shaft 57 exposed from the rubber roller 58.

2) Transfer Roller

The transfer roller 23 includes the roller shaft 57 and the rubber roller 58 covering the periphery of the roller shaft 57, as mentioned above.

2-1) Roller Shaft

The roller shaft 57 is formed of a conductive material of metal, etc., like a round shaft shape.

2-2) Rubber Roller

The rubber roller 58 is formed of a foamable ionic conductive material like a cylinder fitted into the outer side of the roller shaft 57.

The ionic conductive material is a material provided by adding an ionic conductive agent to rubber. As the rubber, acrylonitrile-butadiene rubber, urethane rubber, epichlorohydrin rubber, blend rubber thereof, or the like can be named, for example. As the ionic conductive agent, ammonium salt of tetraethylammonium, tetrabutylammonium, dodecyl trimethylammonium, hexadecyl trimethylammonium, octadecyl trimethylammonium, benzyltrimethylammonium, or denatured fatty acid dimethylethyl ammonium, etc., for example, can be named and alkali metal salt or alkaline earth metal salt of lithium, sodium, potassium, calcium, magnesium, etc., for example, can be named. As the salt, perchlorate, chlorate, hydrochloride, bromate, iodate, fluoroboric acid salt, sulfate, ethyl sulfate, carboxylate, sulfonate, etc., can be named, for example.

The ionic conductive material is prepared by doping rubber with an ionic conductive agent.

The transfer roller 23 is insert-formed together with the roller shaft 57 by blending a foaming agent into the ionic conductive material or is formed by blending a foaming agent into the ionic conductive material and molding like a cylinder and then press fitting into the roller shaft 57.

Accordingly, the rubber roller 58 is formed as a foamable conductive material and covers the surface of the roller shaft 57 along the axial direction of the roller shaft 57 so that both end portions of the roller shaft 57 are exposed.

2-3) Cover Layer

The transfer roller 23 further includes a cover layer 59 between the roller shaft 57 and the rubber roller 58 as shown in FIG. 4. The cover layer 59 is formed as a semiconductive coating layer by applying semiconductive paint such as paint provided by blending an appropriate amount of metal powder, carbon, etc., into resin (acrylic resin, vinyl resin, epoxy resin, etc.) to the surface of the roller shaft 57. The cover layer 59 can provide a resistance value of 50 kΩ to 100 kΩ per μm of film thickness.

The cover layer 59 is provided in both end portions in the axial direction of the roller shaft 57. Each cover layer 59 is provided so that a resistance value R1 at the center portion in the axial direction of the transfer roller 23 (the center portion in the axial direction means almost the center in the axial direction except for the case as axial position percentage reference described later) and a resistance value R2 in both end portions in the axial direction of the transfer roller 23 when the transfer roller 23 is brought into press contact with the photoconductive drum 21 become close to each other (or substantially become equal).

Specifically, each cover layer 59 is provided as a resistance value for substantially complementing the difference between the resistance value at the center portion in the axial direction of the rubber roller 58 and the resistance value in the end portion in the axial direction of the rubber roller 58 when the transfer roller 23 is brought into press contact with the photoconductive drum 21. That is, first the resistance value R1 at the center portion in the axial direction of the transfer roller 23 and the resistance value R2 in the end portion in the axial direction of the transfer roller 23 when the transfer roller 23 is brought into press contact with the photoconductive drum 21 are measured. Next, the resistance value R2 is subtracted from the resistance value R1 and each cover layer 59 is provided with a film thickness so as to become the resistance value corresponding to the difference.

For example, if a midpoint from the center portion to the end portion in the axial direction of the roller shaft 57 is displayed in the percentage where the center portion is 0% position and the end portion is 100% position (hereinafter the percentage will be assumed to be axial position percentage), the inner end portion in the axial direction of each cover layer 59 is placed in 30% to 50% position and the outer end portion in the axial direction of each cover layer 59 is placed in 90% to 100% position. The axial area of each cover layer 59 is set to 30% to 100%. The film thickness of each cover layer 59 is selected based on the resistance value to be set out of the range of 6 to 13 μm, for example. In this case, the end margin in the axial direction of the rubber roller 58 is placed in 90% to 95% position.

The axial area for providing each cover layer 59 can also be set according to the following method.

a) First, resistance values of several points in the axial direction of the transfer roller 23 when the transfer roller 23 is brought into press contact with the photoconductive drum 21 are measured and a correlation diagram of plotting the resistance values of the transfer roller 23 relative to the axial position percentage is obtained.

In the measurement, insulating tape 61 provided with one notch 60 (for example, 10 mm) in the axial direction is intervened between the photoconductive drum 21 with the photosensitive layer (insulating layer) removed and the transfer roller 23 (the length of the rubber roller 58 is 215 mm), for example, as shown in FIG. 5.

After the transfer roller 23 is brought into press contact with the photoconductive drum 21 by pressure F (for example, 6 N), voltage V (for example, 2 kV) is applied to the nip between the drum shaft 34 and the roller shaft 57 and the resistance value of the transfer roller 23 at the position of the notch 60 is found.

Then, the position of the notch 60 of the insulating tape 61 is changed and resistance values of several points of the transfer roller 23 are found in the axial direction. The resistance values are found symmetrically with respect to the axial center, for example.

Then, a correlation diagram of plotting the resistance values of the transfer roller 23 relative to the axial position percentage is obtained, for example, as shown in FIG. 6A. In the correlation diagram, the resistance value becomes the highest at the axial center portion and decreases from the axial center portion to the axial end portion symmetrically with respect to the axial center portion.

b) Next, each cover layer 59 is set so as to become symmetrical from the axial center portion, as shown in FIG. 6B. In this setting, the resistance value plot line is moved in parallel upward so that a resistance value RC at the axial center portion and a resistance value RIa in the axial inner end portion after the cover layer 59 is applied become substantially the same and that a resistance value RIb in the axial inner end portion before the cover layer 59 is applied and a resistance value RX in the axial outer end portion after the cover layer 59 is applied become substantially the same. The axial area of each cover layer 59 is set as an area between the axial position percentage in the axial inside of the plot line moved in parallel and the axial position percentage in the axial outside.

2-4) Press Unit

The press units 62 are provided in a pair so as to face the insertion holes 56 from below in the main body casing 2 when the process cartridge 14 is placed in the main body casing 2, as shown in FIG. 4. That is, each press unit 62 is placed in both the axial end portions of the transfer roller 23 when the process cartridge 14 is placed in the main body casing 2.

Each press unit 62 includes a press plate 63 and a spring 64 as shown in FIG. 3B.

The front portion of the press plate 63 is supported rotatably on a support axis 65 provided in the main body casing 2. The rear portion of the press plate 63 is placed so that it can abut the end portion of the roller shaft 57 from below through the insertion hole 56 when the process cartridge 14 is placed in the main body casing 2.

The spring 64 is a compression spring and urges the rear portion of the press plate 63 upward. The spring loads of the springs 64 of the press units 62 are set to almost the same.

2-5) Support of Transfer Roll

Both end portions of the roller shaft 57 are supported on the support plates 55 of the drum frame 51 movably in the up and down direction and rotatably. Thus, when the process cartridge 14 is detached from the main body casing 2, both end portions of the roller shaft 57 are supported in the deepest portions of the notches each roughly like a letter U, of the support plates 55, as shown in FIG. 3A. Accordingly, the transfer roller 23 is placed with a spacing in the up and down direction relative to the photoconductive drum 21.

In contrast, when the process cartridge 14 is placed in the main body casing 2, both end portions of the roller shaft 57 are pressed by the rear portion of the press plate 63 urged by the spring 64, as shown in FIG. 3B. Accordingly, the transfer roller 23 is brought into press contact with the photoconductive drum 21 from below.

Since the spring loads of the springs 64 are set to almost the same, the roller shaft 57 is pressed at both end portions at almost the same pressure by the springs 64.

3. Function and Advantages

If both end portions of the roller shaft 57 are pressed against the photoconductive drum 21 by the press plate 63, the rubber roller 58 made of a foam material comes in press contact with the photoconductive drum 21 and is compressed. The resistance value in the axial direction of the transfer roller 23 at this time becomes higher at the center portion than that in the both end portions as described above. Thus, a current becomes easy to flow into both end portions and becomes hard to flow into the center portion and therefore if a transfer bias is applied, a uniform current does not flow in the axial direction and a transfer failure is caused to occur.

However, the transfer roller 23 is provided with the cover layer 59 between the roller shaft 57 and the rubber roller 58 in both the axial end portions as described above. Thus, the resistance value of the transfer roller 23 in both the axial end portions can be increased. Consequently, the difference in resistance value along the axial direction of the transfer roller 23 can be decreased and a transfer failure caused by the difference can be prevented.

The rubber roller 58 is formed of an ionic conductive material and thus is expensive as compared with a rubber roller 58 with conductive particles dispersed and if a plurality of rubber rollers 58 different in resistance value are provided in a division manner in the axial direction, an increase in the cost is inevitable.

In the transfer roller 23, however, the semiconductive cover layer 59 is intervened between the roller shaft 57 and the rubber roller 58. Therefore, the resistance value of the transfer roller 23 in the axial direction can be adjusted while the rubber roller 58 of the same resistance value is provided without providing a plurality of rubber rollers 58 different in resistance value. Thus, the configuration can be simplified and the cost can be reduced.

The transfer roller 23 is provided with the cover layers 59 so that the resistance value at the center portion in the axial direction of the transfer roller 23 and the resistance value in both end portions in the axial direction of the transfer roller 23 when the transfer roller 23 is brought into press contact with the photoconductive drum 21 become close to each other or substantially become equal. Thus, the difference in resistance value of the transfer roller 23 along the axial direction of the roller shaft 57 can be lessened or can be substantially eliminated. Consequently, a transfer failure can be still more prevented.

The transfer roller 23 is provided with the cover layers 59 as a resistance value for substantially complementing the difference between the resistance value at the center portion in the axial direction of the rubber roller 58 and the resistance value in the end portion in the axial direction of the rubber roller 58 when the transfer roller 23 is brought into press contact with the photoconductive drum 21. Thus, the resistance values of the transfer roller 23 along the axial direction of the roller shaft 57 can be made substantially uniform and consequently a transfer failure can be still more prevented.

The transfer roller 23 is provided with the cover layers 59 over the area between the axial position percentage in the axial inside of the plot line moved in parallel and the axial position percentage in the axial outside. Thus, the difference in resistance value of the transfer roller 23 along the axial direction of the roller shaft 57 can be decreased reliably according to the simple configuration.

The drum cartridge 19 includes the transfer roller 23 capable of preventing a transfer failure caused by the difference in resistance value. Thus, the toner image from the photoconductive drum 21 can be transferred reliably to the sheet 6.

Further, since the laser printer 1 includes the drum cartridge 19, an image can be formed reliably on the sheet 6.

4. First Modified Example

Figure 7:
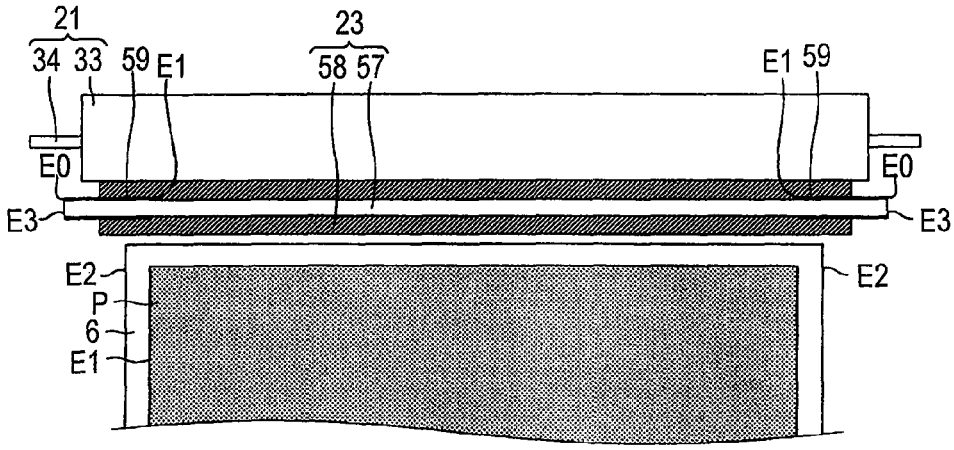
FIG. 7 is an exemplary sectional view of a transfer roller of a first modified example in a width direction.
Figure 8:
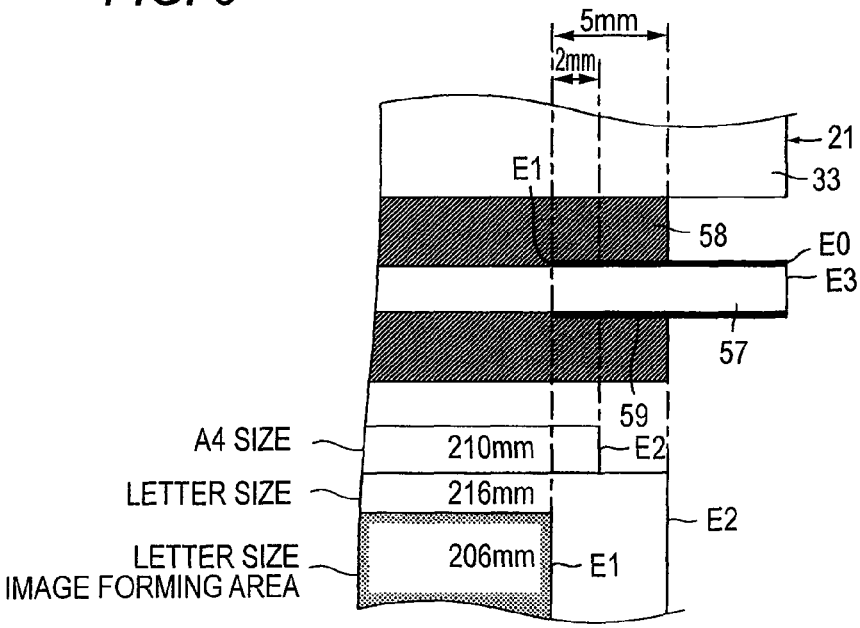
FIG. 8 is an enlarged view of FIG. 7.

FIG. 7 is a sectional view in a width direction of a transfer roller of a first modified example. FIG. 8 is an enlarged view of a main part in FIG. 7. Members similar to those previously described with reference to the accompanying drawings are denoted by the same reference numerals in FIGS. 7 and 8 and only the different potions from the members described above will be discussed.

1) Transfer Roller

In FIG. 7, a cover layer 59 is provided in both end portions in the axial direction of a roller shaft 57. In each cover layer 59, an axial inner end margin EI and an axial outer end margin EO are placed at the following positions in the axial direction:

The axial inner end margin EI of each cover layer 59 is placed between an end margin E1 of an image forming area P of a sheet 6 and an end margin E2 of the sheet 6 (containing the end margin E1 and the end margin E2).

In setting of the axial inner end margin EI, a sheet 6 of the same size most frequently used (for example, A4 size) can be used as the reference to the end margin E1 and the end margin E2. Of sizes of sheets frequently used, a sheet 6 of a large size (for example, letter size) can be used as the reference to the end margin E1 and a sheet 6 of a small size frequently used (for example, A4 size) can be used as the reference to the end margin E2 (see FIG. 8). Further, a sheet 6 of the maximum size where an image can be formed on the laser printer 1 (for example, letter size) can be used as the reference to the end margin E1 and a sheet 6 of the minimum size where an image can be formed on the laser printer 1 (for example, postcard size, B5 size) can be used as the reference to the end margin E2.

The axial outer end margin EO of each cover layer 59 is placed between the end margin E2 of the sheet 6 and an end margin E3 of the roller shaft 57 (containing the end margin E2 and the end margin E3).

In setting of the axial outer end margin EO, a sheet 6 of the size most frequently used (for example, A4 size) can be used as the reference to the end margin E2. Of sizes of sheets frequently used, a sheet 6 of a large size (for example, letter size) can be used as the reference to the end margin E2 (see FIG. 8). Further, a sheet 6 of the maximum size where an image can be formed on the laser printer 1 (for example, letter size) can be used as the reference to the end margin E2.

2) Function and Advantage of the First Modified Example

The transfer roller 23 of the first modified example is provided with the cover layers 59 in the area from the end margin E1 of the image forming area P to the end margin E3 of the roller shaft 57 so as to pass through the end portions of the sheet 6 in the axial direction. Thus, when an image is formed, passage of a transfer current can be abruptly decreased in both end portions of the sheet 6. Accordingly, deposition of paper dust much existing in both end portions of the sheet 6 on a photoconductive drum 21 can be decreased.

5. Second Modified Example

Figure 9:
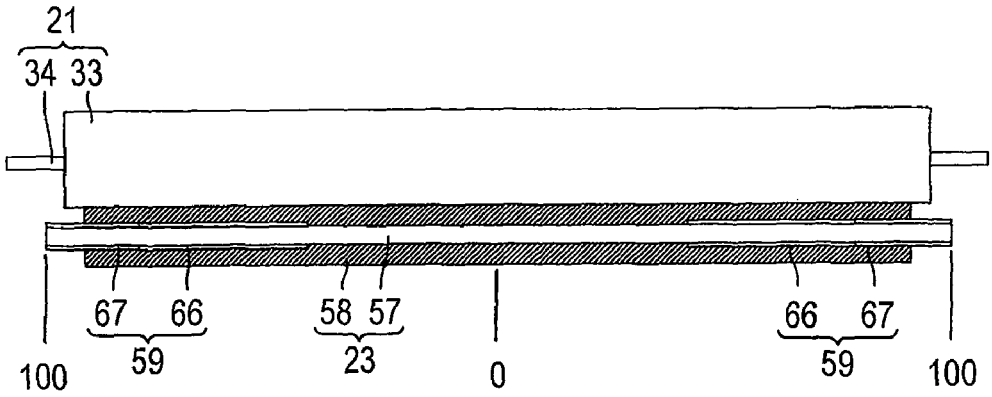
FIG. 9 is an exemplary sectional view of a transfer roller of a second modified example in a width direction.

FIG. 9 is a sectional view in a width direction of a transfer roller of a second modified example. Members similar to those previously described with reference to the accompanying drawings are denoted by the same reference numerals in FIG. 9 and only the different potions from the members described above will be discussed.

1) Transfer Roller

In FIG. 9, a plurality of cover layers 59 are provided so that the resistance value increases from the axial center portion to axial end portions in the axial direction of a roller shaft 57. Specifically, two pairs of cover layers 59 each pair placed symmetrically with respect to the axial center portion are provided.

That is, in a transfer roller 23 of a second modified example, the cover layers 59 include a pair of inner cover layers 66 provided symmetrically in the axial inside with respect to the axial center portion and a pair of outer cover layers 67 provided symmetrically in the axial outside with respect to the axial center portion.

The inner cover layers 66 are placed symmetrically with respect to the axial center portion and are spaced from each other in the axial direction.

The inner end portion in the axial direction of each inner cover layer 66 is placed in 10% to 30% position in the axial position percentage and the outer end portion in the axial direction of each inner cover layer 66 is placed in 40% to 60% position in the axial position percentage. The axial area of each inner cover layer 66 is set to 10% to 60%. The film thickness of each inner cover layer 66 is selected based on the resistance value to be set out of the range of 3 to 6 μm, for example. In this case, the end margin in the axial direction of a rubber roller 58 is placed in 90% to 95% position.

The outer cover layers 67 are placed symmetrically with respect to the axial center portion and are spaced from each other in the axial direction. Each outer cover layer 67 is placed adjacent to each inner cover layer 66 in the axial outside of the inner cover layer 66.

The inner end portion in the axial direction of each outer cover layer 67 is placed in 40% to 60% position in the axial position percentage and the outer end portion in the axial direction of each outer cover layer 67 is placed in 90% to 100% position in the axial position percentage. The axial area of each outer cover layer 67 is set to 40% to 100%. The film thickness of each outer cover layer 67 is formed larger than that of each inner cover layer 66 and is selected based on the resistance value to be set out of the range of 8 to 15 μm, for example.

2) Function and Advantage of the Second Modified Example

The transfer roller 23 of the second modified example is provided with the cover layers 59 so that the resistance value increases from the axial center portion to axial end portions. Thus, the difference in resistance value of the transfer roller 23 along the axial direction of the roller shaft 57 can be decreased. Consequently, a transfer failure can be prevented.

Specifically, the transfer roller 23 of the second modified example includes a pair of inner cover layers 66 and a pair of outer cover layers 67 placed adjacent to the outside of the inner cover layers 66. The resistance value of the pair of outer cover layers 67 is set higher than the resistance value of the pair of inner cover layers 66. Thus, the resistance value of the transfer roller 23 can be increased stepwise from the axial center portion to both the axial end portions. Consequently, the resistance values of the transfer roller 23 along the axial direction of the roller shaft 57 can be made almost uniform according to the simple configuration.

6. Other Examples

Although two pairs of cover layers 59 each pair placed symmetrically with respect to the axial center portion are provided in the second modified example, more than two pairs can also be provided.

In the above-described aspects, the resistance value is the same for each cover layer 59. However, the resistance value can also be gradually increased for each cover layer 59, for example, by gradually decreasing the thickness of each cover layer 59 from the axial inside to the axial outside. In this case, the resistance value can also be gradually increased, for example, by providing only one pair of cover layers 59 symmetrical with respect to the axial center portion and gradually decreasing the thickness of each cover layer 59 from the axial inside to the axial outside.

In the above-described aspects, the spring loads of the springs 64 are set to almost the same in the pair of press units 62 and thus the cover layers 59 are placed symmetrically with respect to the axial center portion. However, if the spring loads of the springs 64 differ, the cover layers 59 are placed at symmetrical positions or at positions shifting from symmetrical positions based on a part shifting from the axial center portion corresponding to the difference ratio.

In the above-described aspects, the cover layer 58 is provided up to the axial end margin of the roller shaft 57. However, if the cover layer 58 is formed in the axial end portion of the roller shaft 57, it may be unnecessary to form the cover layer 59 up to the axial end margin of the roller shaft 57 in response to the purpose, etc. In this case, the axial outer end margin of the cover layer 59 is placed with a spacing in the axial inside from the axial end margin of the roller shaft 57.

In the above-described aspects, the transfer roller 23 is provided in the drum cartridge 19, but can also be provided directly in the main body casing 2. Further, in the description given above, a monochrome color laser printer is illustrated in the invention, but the image forming apparatus of the invention can also be configured as a color laser printer. For example, the color laser printer may include tandem type and intermediate transfer type.

What is claimed is:

1. A transfer unit comprising:

a transfer roller including an electrically conductive rotation shaft;

a conductive elastic layer for covering a periphery of the rotation shaft; and a semiconductive cover layer provided between the rotation shaft and the elastic layer at least in both end portions in an axial direction of the rotation shaft, wherein the semiconductive cover layer includes an inner cover layer, and an outer cover layer, which is axially outside of the inner cover layer, the outer cover layer being thicker than the inner cover layer to provide a resistance value larger than a resistance value of the inner cover layer.

2. The transfer unit according to claim 1, wherein when the transfer roller is pressed against a photoconductor, a resistance value in a center portion of the transfer roller in the axial direction is substantially equal to a resistance value in both end portions of the transfer roller in the axial direction.

3. The transfer unit according to claim 1, wherein when the transfer roller is pressed against the photoconductor, the semiconductive cover layer has a resistance value for substantially complementing a difference between a resistance value of the elastic layer in a center portion in the axial direction and a resistance value of the elastic layer in both end portions in the axial direction.

4. The transfer unit according to claim 1, wherein:

the outer cover layer is provided in each of both end portions in the axial direction of the rotation shaft; and each of the outer cover layers includes:

a first end that is configured to contact an image forming area of a transfer medium; and a second end disposed outside the first end and outside of the image forming area of the transfer medium.

5. The transfer unit according to claim 1, wherein the thickness of the semiconductive cover layer increases from an inner end of the inner cover layer in the axial direction to each of both end portions of the outer cover layer in the axial direction of the rotation shaft.

6. The transfer unit according to claim 1, wherein the conductive elastic layer is ionic.

7. A photoconductor cartridge comprising:

a transfer unit including a transfer roller including an electrically conductive rotation shaft;

a conductive elastic layer for covering a periphery of the rotation shaft; and a semiconductive cover layer provided between the rotation shaft and the elastic layer at least in both end portions in an axial direction of the rotation shaft, wherein the semiconductive cover layer includes an inner cover layer, and an outer cover layer, which is axially outside of the inner cover layer, the outer cover layer being thicker than the inner cover layer to provide a resistance value larger than a resistance value of the inner cover layer; and a photoconductor that faces the transfer roller in order to press contact with the transfer roller, the photoconductor carrying a developer image.

8. The photoconductor cartridge according to claim 7, wherein the conductive elastic layer is ionic.

9. The photoconductor cartridge according to claim 7, wherein the outer cover layer is provided in each of both end portions in the axial direction of the rotation shaft; and each of the outer cover layers includes:

a first end that is configured to contact an image forming area of a transfer medium; and a second end disposed outside the first end and outside of the image forming area of the transfer medium.

10. The photoconductor cartridge according to claim 7, wherein the thickness of the cover layer increases from an inner end of the inner cover layer in the axial direction to each of both end portions of the outer cover layer in the axial direction of the rotation shaft.

11. An image forming apparatus comprising:

a transfer unit including a transfer roller including an electrically conductive rotation shaft;

a conductive elastic layer for covering a periphery of the rotation shaft; and a semiconductive cover layer provided between the rotation shaft and the elastic layer at least in both end portions in an axial direction of the rotation shaft, wherein the semiconductive cover layer includes an inner cover layer, and an outer cover layer, which is axially outside of the inner cover layer, the outer cover layer being thicker than the inner cover layer to provide a resistance value larger than a resistance value of the inner cover layer;

a photoconductor that faces the transfer roller in order to press contact with the transfer roller, the photoconductor carrying a developer image; and a press member that presses both end portions in the axial direction of the transfer roller against the photoconductor.

12. The image forming apparatus according to claim 11, wherein the conductive elastic layer is ionic.

13. The image forming apparatus according to claim 11, wherein the outer cover layer is provided in each of both end portions in the axial direction of the rotation shaft; and each of the outer cover layers includes:

a first end that is configured to contact an image forming area of a transfer medium; and a second end disposed outside the first end and outside of the image forming area of the transfer medium.

14. The image forming apparatus according to claim 11, wherein the thickness of the cover layer increases from an inner end of the inner cover layer in the axial direction to each of both end portions of the outer cover layer in the axial direction of the rotation shaft.

* * * * *